US005529392A

United States Patent [19]

O'Donnell et al.

[11] Patent Number: 5,529,392

[45] Date of Patent: Jun. 25, 1996

[54] APPARATUS FOR EMULSIFICATION OF LIQUID POLYMERIC SOLUTIONS

[76] Inventors: Garry O'Donnell, 1377 Stationmaster Lane, Oakville, Ontario, Canada, L6M 3A6; Dan Copeland, 1591 King Street East, Hamilton, Ontario, Canada, L8K 1T5

[21] Appl. No.: 152,723

[22] Filed: Nov. 15, 1993

[51] Int. Cl.[6] ..... B01F 15/02

[52] U.S. Cl. ..... 366/155.1; 366/159.1; 366/163.2; 366/182.4

[58] Field of Search ..... 366/132, 136, 366/137, 154, 155, 159, 160, 162, 167, 182, 155.1, 159.1, 163.2, 182.4; 137/3, 563, 565, 896, 897

[56] References Cited

U.S. PATENT DOCUMENTS

| | | | |
|---|---|---|---|
| 3,208,829 | 9/1965 | Terenzi | 366/136 X |
| 4,057,223 | 11/1977 | Rosenberger | 366/172 |
| 4,218,147 | 8/1980 | Rosenberger | 366/162 |
| 4,274,749 | 6/1981 | Lake et al. | 366/132 |
| 4,482,704 | 11/1984 | Luetzelschwab | 366/137 X |
| 4,642,222 | 2/1987 | Brazelton | 137/3 X |
| 4,660,988 | 4/1987 | Hara et al. | 366/137 |
| 4,664,528 | 5/1987 | Rodgers et al. | 366/137 X |
| 4,747,691 | 5/1988 | Hoffland | 366/160 |
| 4,778,280 | 10/1988 | Brazelton | 366/136 |
| 4,863,277 | 9/1989 | Neal et al. | 366/137 |
| 5,052,486 | 10/1991 | Wilson | 366/136 X |
| 5,211,475 | 5/1993 | McDermott | 366/137 |
| 5,372,421 | 12/1994 | Pardikes | 366/162 X |

*Primary Examiner*—David Scherbel
*Assistant Examiner*—Charles E. Cooley
*Attorney, Agent, or Firm*—Gifford, Krass, Groh, Sprinkle, Patmore, Anderson & Citkowski

[57] ABSTRACT

A method and apparatus for emulsification of concentrated liquid polymeric solution. The apparatus includes a recirculation system from a storage tank. The recirculation system has a supply line and a return line and diverter valve which is operated for a period of time before the emulsification process begins. The method includes the steps of purging mixed polymeric solution from the volute of a pump after mixing and a recirculation cavity for delivering a portion of mixed diluted polymeric solution to a flow of concentrated polymeric solution before eduction and hydration.

3 Claims, 2 Drawing Sheets

APPARATUS FOR EMULSIFICATION OF LIQUID POLYMERIC SOLUTIONS

FIELD OF THE INVENTION

A method and apparatus for emulsification of liquid polymeric solutions, and more particularly, a method and apparatus for diluting by the hydration of concentrated polymeric solutions.

BACKGROUND OF THE INVENTION

Liquid synthetic polymeric solutions are emulsified or activated in order to render a solution usable for various processes. The emulsification of concentrated liquid synthetic polymeric solution requires the stripping of oil which surrounds polymer capsules and subsequently hydrating the polymer capsules After the polymer capsules are hydrated, the polymer solution is aged. The polymer solution swells and elongates (uncoils) rendering a solution usable for further processing.

Emulsification of concentrated polymeric solution (CPS) is typically accomplished by feeding a supply of CPS from a storage tank through a metering pump and a supply line to an eductor system. The eductor system includes a high speed centrifugal pump (HSCP) where CPS is mixed with water to form a diluted polymer solution (DPS). The diluted polymer solution (DPS) is then delivered to an aging tank where DPS is stored for aging. After aging, the DPS is usable for further processes. After the aging tank is filled, the metering pump and high speed centrifugal pump are shut off. When the aging tank is emptied, the metering pump and high speed centrifugal pump are activated to emulsify a new supply of CPS from the neat storage tank.

However, the emulsification of CPS requires precise control of the conditions in order to produce high quality polymeric solutions. The CPS is known to separate over time into oil and neat polymer, forming a non-homogeneous CPS.

In the previously known emulsification systems, CPS remains in the feed supply from the storage tank to the eductor system after shutdown of the pumps. If the system is shut down for more than a short time, the CPS separates into non-homogeneous CPS. Thus, when the pumps of the previously known systems are restarted, non-homogeneous CPS is delivered to the eductor system for hydration. The DPS mixed using the non-homogeneous CPS produces inferior DPS.

Additionally, highly viscous aged DPS is accumulated in the HSCP upon shutdown of the pumps. When the system is restarted after shutdown the accumulation of highly viscous DPS requires a pump motor capable of producing high torque to pump the highly viscous aged DPS.

SUMMARY OF THE INVENTION

The present invention Is directed to a method and apparatus overcoming the above problems and for producing high quality DPS. In accordance with the present invention, the apparatus includes a tank having a supply of concentrated polymeric solution (CPS) connected to a supply line for delivering the CPS to an eductor system for hydration The CPS is pumped through the supply line to a three-way valve located near the eductor system The valve is also connected to a return line connected to the tank. The valve is selectively operable to divert the CPS in the supply line between the eductor system and the return line to the CPS tank The eductor system is connected to a supply of water for mixing with the CPS to provide a diluted polymeric solution. The diluted polymeric solution is delivered by a delivery line to an aging tank When the CPS is fed to the eductor system, it flows to a first mixing chamber where a flow of diluted polymeric solution is added to form a mixed solution. The mixture is hydrated with water.

The mixed polymeric solution then passes through an eductor nozzle into a second mixing chamber in a high speed centrifugal pump where the mixed polymeric solution is combined with water to form a diluted polymeric solution. The diluted polymeric solution is then delivered by the high speed centrifugal pump to an output line. The output line delivers the diluted solution to an aging tank where the diluted polymeric solution is stored for aging. However, a smaller portion of the diluted polymeric solution flows from a volute of the pump back to the first mixing chamber The method according to the invention includes a first step of recirculating a flow of concentrated polymeric solution from a storage tank into a supply line and then into a return line back to the tank. The concentrated polymeric solution is recirculated and agitated in the tank for a predetermined length of time to mix and homogenize the solution. After recirculation, the flow of concentrated polymeric solution is delivered to an eductor system where the concentrated polymeric solution is hydrated and then aged in a tank.

The method also includes a shutdown procedure for the apparatus stopping the flow of concentrated polymeric solution to the eductor and purging the eductor with a flow of water for a predetermined period of time after the flow of polymeric solution is stopped. The apparatus and method results in an improved quality of emulsified polymeric solution permitting the use of a smaller eductor pump motor and improving the quality of the diluted polymeric solution.

BRIEF DESCRIPTION OF THE DRAWINGS

The forgoing and other objects and features of the present invention will become more apparent upon consideration of the following description taken in connection with the accompanying drawings wherein.

DESCRIPTION OF THE PREFERRED EMBODIMENTS

Figure 1:
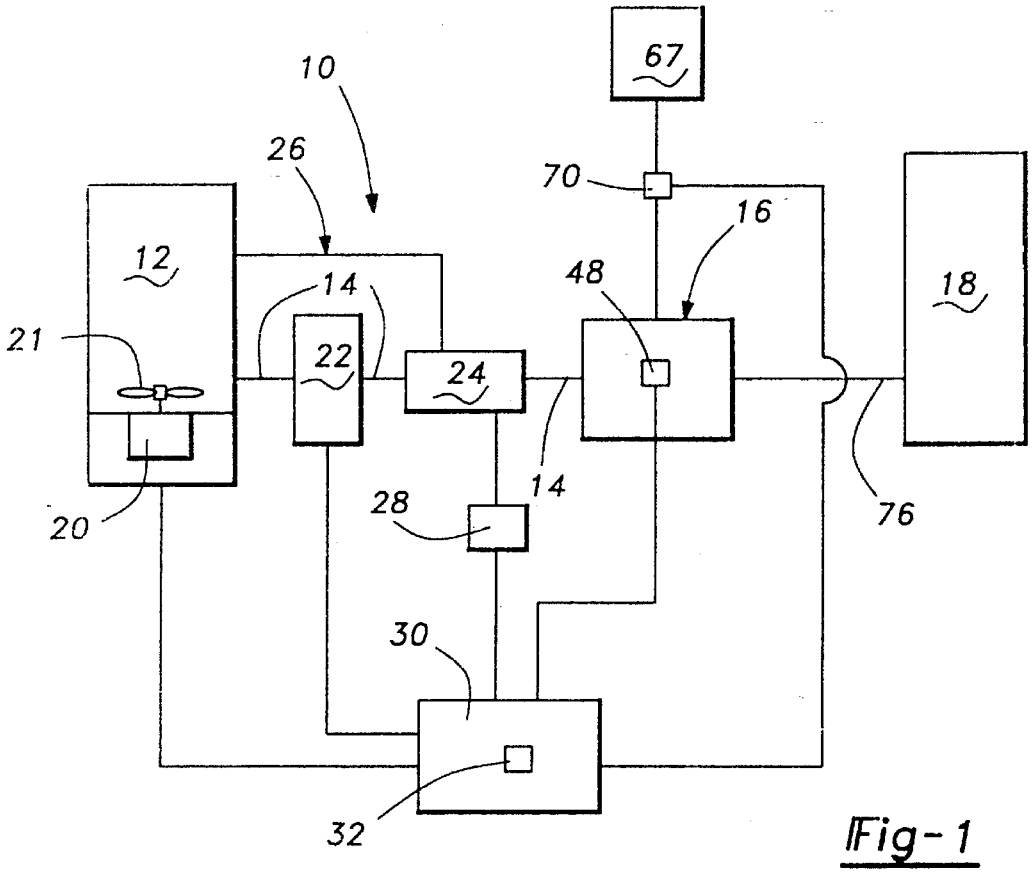
FIG. 1 is a schematic illustration depicting an apparatus for the emulsification of liquid polymeric solutions according to the invention.

An apparatus 10 for the emulsification or activation of liquid synthetic polymeric solution is illustrated in FIG. 1. The apparatus 10 includes a storage tank 12 for neat or concentrated liquid polymer (CPS). The CPS is delivered from the storage tank 12 by a supply line 14 to an eductor system 16. In the eductor system 16, the CPS is hydrated to form a diluted polymeric solution (DPS) and then delivered to an aging tank 18 where the DPS is aged.

The storage tank 12 may be of any conventional type suitable for storing the neat or concentrated polymeric solution. The tank 12 is preferably formed of rigid material, such as stainless steel or polyethylene, and includes an agitator 20. The agitator 20 may be of any suitable type mounted in the tank to mix the CPS such as a blade 21 rotated by an electric motor. The electric motor is connected to a control unit having switches for controlling the operation of the motor. The agitator 20 operates at low speed from, for instance, 0 to 715 rpm to agitate the concentrated polymeric solution and prevent separation.

A metering pump 22 is connected to the supply line 14 to pump a metered flow of CPS under flooded suction condition from the bottom of the tank 12 to a three-way valve 24 located closely adjacent the eductor system 16. The supply line 14 may be of any suitable type, such as stainless steel conduit. The pump may be of any suitable type.

The valve 24 is operable to divert the CPS being pumped from the storage tank 12 through the supply line 14 to a return line 26 which is connected to the top of the storage tank 12. The valve 24 may be of any conventional type, such as a three-way ball valve, which is operable to divert the entire flow from the supply line 14 to either the return line 26 or the eductor system 16. The valve 24 is moved to direct the flow by an electric actuator 28. The actuator is electrically connected to a control unit 30 having a timer 32 as will be discussed in more detail below. A suitable valve and actuator are available from Neles Tarnesbury of Worchester, Mass.

Figure 3:
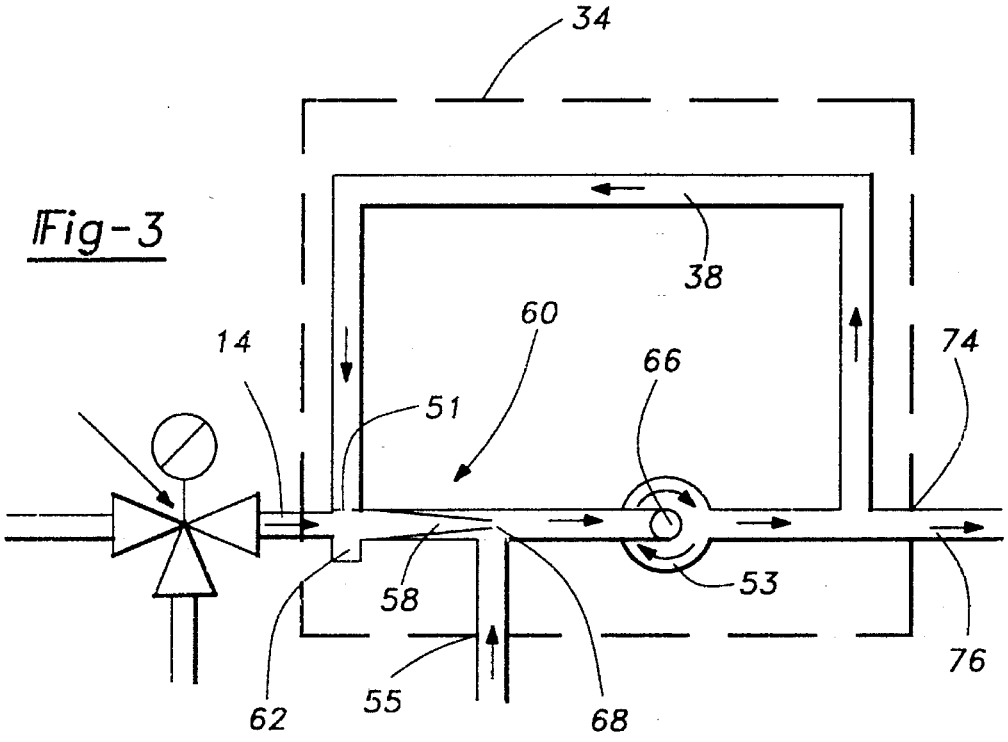
FIG. 3 is a schematic illustration of the eductor system according to the invention.
Figure 2:
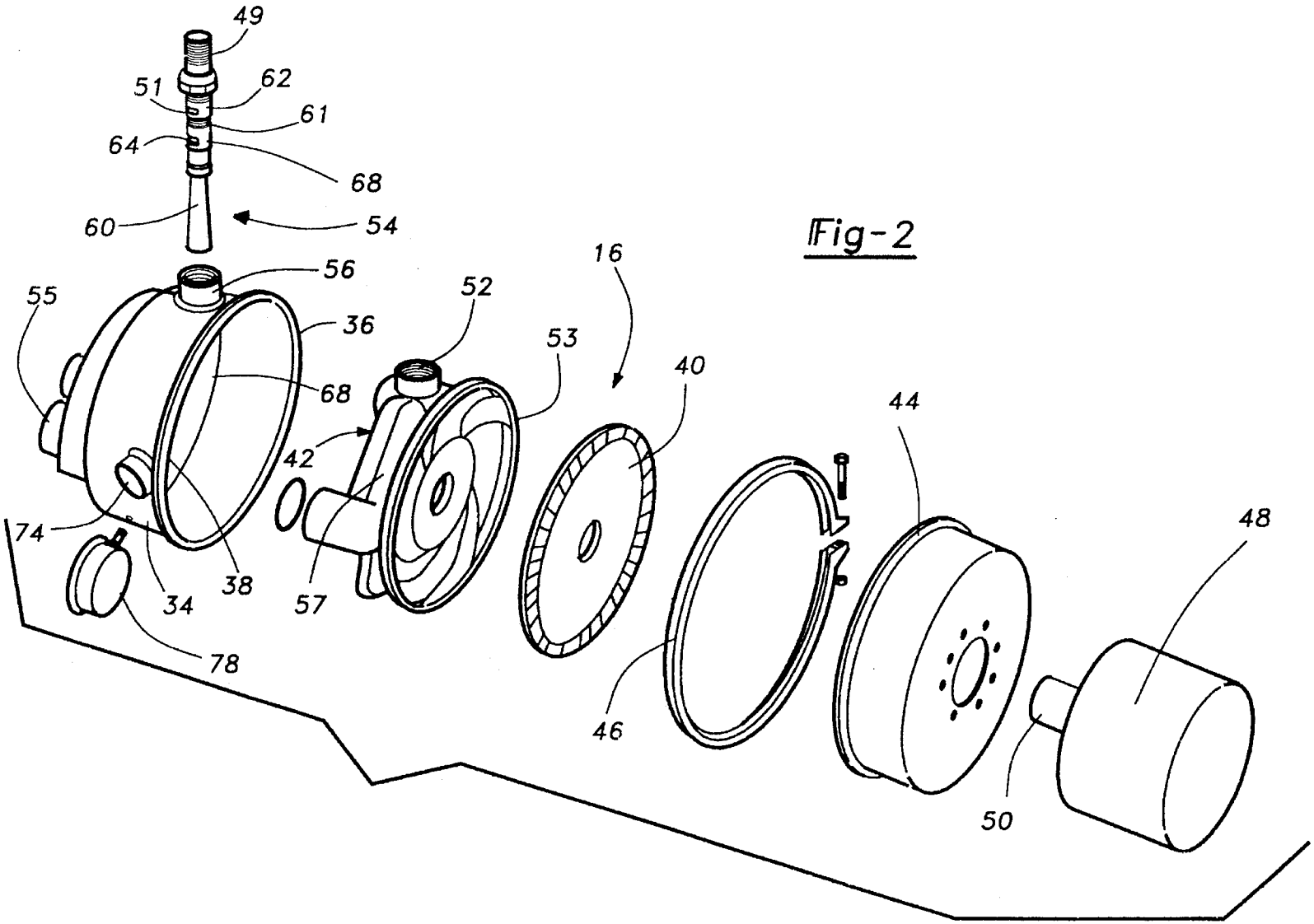
FIG. 2 is an exploded view of an eductor system for use in the emulsification apparatus according with the invention.

As best shown in FIGS. 2 and 3, the eductor system 16 includes a housing 34 having an opening 36 defining a cavity 38. The cavity 38 holds an impeller 40 and subassembly 42. A cover 44 is mounted to the housing 34 by a ring 46 to close the opening 36 The cover 44 supports an electric motor 48 having a shaft 50 for rotatably driving the impeller 40.

The eductor 54 is threadably mounted in an aperture 56 of the housing 34 The eductor 54 has a fitting 49 at an outer end to connect to the supply line 14. The eductor 54 is sealingly mounted to an aperture 52 in the subassembly 42 by threads 61. The eductor 54 has a longitudinal passageway 60 having a first mixing chamber 62. The first mixing chamber has an opening 51 communicating with the cavity 38 inside the housing. The opening 51 in the eductor 54 permits diluted polymeric solution (DPS) in the cavity 38 from a volute 53 to pass through the opening 51 into the first mixing chamber 62 where the DPS is mixed with CPS from the supply line 14.

The mixture of diluted polymeric solution and concentrated polymeric solution flows through the nozzle 58 (FIG. 3) into a second mixing chamber 68 where water is provided. The water is delivered from a reservoir 67 and is delivered through a shut off valve 70 through an inlet 55 in the housing 34 to a bore 57 of the subassembly 42. The water in bore 57 is delivered by an opening 64 into the second mixing chamber 68 where the water is mixed with the mixed solution flowing from the nozzle 58 to form diluted polymeric solution The diluted polymeric solution flows from the passageway 60 of the eductor 54 through opening 66 into the volute 53 where the impeller 40 mixes the solution. The pump motor 48 operates to drive the impeller 40 at a relatively high speed of 3500 rpm. A portion of the mixed diluted polymeric solution exits the housing 34 through an outlet 74 and is delivered by line 76 to the aging tank 18. A smaller amount of DPS, up to approximately 25% of the DPS in the volute of the impeller 40 flows into the cavity 38, through opening 51 into the first mixing chamber 62 for mixing with the concentrated polymeric solution as set forth above.

The eductor system 16 thus introduces concentrated polymeric solution to recirculated diluted polymeric solution rather than introducing the concentrated polymeric solution directly to water. The two mixing zones together with the internal recirculation of the diluted polymeric solution, results in producing a fully activated homogeneous product As is known in the art, polymer swells and elongates with aging and becomes more viscous. After aging the diluted polymeric solution is now activated and ready for further processing.

Operation

The operation of the apparatus is directed by the control unit 30 which includes a timer 32, memory, and switches to control the operation of the various elements. The emulsification or activation of liquid synthetic polymeric solution includes a prestart cycle. The prestart cycle begins with a signal from the control unit 30 to energize the agitator 20 within the storage tank 12 of the metering pump 22. The valve 24 is positioned in a recycle position so that the CPS flows through the metering pump 22 at the full capacity of the pump into the supply line 14 and into the return line 26 and is delivered back to the storage tank 12 The prestart cycle is continued for five to ten minutes to fully mix the concentrated polymeric solution. In this way, a homogeneous concentrated polymeric solution is provided.

After the completion of the prestart cycle, the control unit 30 directs the actuator 28 to move the valve 24 to divert the flow of CPS from the return line 26 into the eductor system 16. At the same time, the control unit 30 energizes the high speed centrifugal mixing pump motor 48 and opens the valve 70 to supply water to the eductor system 16. Upon energization of the high speed centrifugal pump motor 48 concentrated polymeric solution is introduced into the first mixing chamber 62. The CPS is fed through the eductor nozzle 58 into the second mixing chamber 68 where water from the water supply is added to dilute the polymeric solution. The dilution is spun through the volute of the high speed centrifugal pump by the impeller 40.

After passing through the volute 53 of the high speed centrifugal mixing pump, a portion of diluted mixture flows through the cavity 38 to the first mixing chamber 62 where it is mixed with concentrating polymeric solution flowing from the fitting 49. The remaining diluted polymeric solution flows out of the outlet 74 through a line 76 to the aging tank 18 where it is held for aging. A pressure gage 78 may be mounted to the housing to show pressure in the cavity 38.

The method and apparatus thus result in introducing concentrated polymeric solution to recirculated polymeric solution rather than introducing concentrated polymeric solution directly to water. This method results in a fully activated homogeneous product.

After the aging tank 18 is filled to capacity, the control unit 30 is activated to begin a shutdown cycle. Upon shutdown, the control unit 30 directs the actuator to move the valve 24 to divert the flow of concentrated polymeric solution from the eductor system 16 into the return line 26. The metering pump 22 and the agitator 20 are stopped. The valve 70 from the water supply 67 is left open for a predetermined period of time, such as thirty to ninety seconds, to flush the eductor system 16. After the eductor system 16 has been flushed, the valve 70 for the water supply 67 is closed and the pump motor 48 is deactivated by the control unit 30 As a result, the eductor system 16 is purged of mixed polymeric solution. Because there is no polymeric solution in the eductor system 16 upon reactivation of the eductor system 16, a smaller motor may be used for the high speed centrifugal pump because the motor is not forced to work against the polymeric solution which has been aging in the eductor system during the shutdown period of the prior art systems.

It should be clear that many variations of the invention may be made without departing from the scope and spirit of this invention.

We claim:

1. An apparatus for emulsification of liquid polymeric solutions, said apparatus comprising:

a tank having a supply of concentrated polymeric solution;

an eductor for diluting said concentrated polymeric solution with water;

a valve having an input port for receiving a flow of said concentrated polymeric solution from said tank, and a pair of output ports said valve selectively operable to deliver all of said flow of concentrated polymeric solution to one of said pair of output ports, one of said pair of output ports being connected to said eductor;

a supply line extending between said tank and said input port of said valve;

a metering pump for delivering a metered flow of said concentrated polymeric solution from said tank through said supply line; said pump being disposed between said tank and said eductor;

a return line extending from the other of said output ports to said tank; and means for controlling the operation of said apparatus, said means for controlling operable to move said valve between a first position for delivering all of said flow of concentrated polymeric solution from said supply line to said eductor and a second position for diverting all of said flow of concentrate polymeric solution from said supply line to said return line and said tank.

2. The apparatus of claim 1 further comprising:

means for agitating said concentrated polymeric solution in said tank.

3. The apparatus of claim 1, wherein said means for controlling includes a timer.

* * * * *